US007180458B2

(12) United States Patent
Hoshi et al.

(10) Patent No.: US 7,180,458 B2
(45) Date of Patent: Feb. 20, 2007

(54) ANTENNA AND INFORMATION COMMUNICATION APPARATUS USING THE ANTENNA

(75) Inventors: Fumikazu Hoshi, Miyagi (JP); Takakuni Minewaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 36 days.

(21) Appl. No.: 11/178,679

(22) Filed: Jul. 11, 2005

(65) Prior Publication Data

US 2006/0012528 A1 Jan. 19, 2006

(30) Foreign Application Priority Data

Jul. 13, 2004 (JP) ..... 2004-206124
Feb. 28, 2005 (JP) ..... 2005-053142

(51) Int. Cl.
*H01Q 13/00* (2006.01)

(52) U.S. Cl. ..... 343/772; 343/773

(58) Field of Classification Search ..... 343/772, 343/773, 846

See application file for complete search history.

(56) References Cited

U.S. PATENT DOCUMENTS

| | | | | |
|---|---|---|---|---|
| 7,002,527 | B2 * | 2/2006 | Sugawara | 343/750 |
| 7,006,047 | B2 * | 2/2006 | Marsan et al. | 343/705 |
| 7,027,004 | B2 * | 4/2006 | Haunberger et al. | 343/790 |
| 2005/0140557 | A1 * | 6/2005 | Kuroda et al. | 343/773 |

FOREIGN PATENT DOCUMENTS

| | | |
|---|---|---|
| JP | 9-83238 | 3/1997 |
| JP | 9-153727 | 6/1997 |

* cited by examiner

*Primary Examiner*—Hoang V. Nguyen
(74) *Attorney, Agent, or Firm*—Cooper & Dunham LLP

(57) ABSTRACT

An antenna including a grounded conductor and a radiating element having a diameter that increases from the top to the bottom in which the top of the radiating element is opposed to the grounded conductor is disclosed. The radiating element of the antenna includes three regions positioned from the top to the bottom, each region having an angle between a side of the radiating element in the region and a center axis of the radiating element, wherein the angles of the three regions satisfy relationship: $\theta 1 > \theta 2$ and $\theta 2 < \theta 3$ when the angles are indicated by $\theta 1$, $\theta 2$ and $\theta 3$ respectively from the top to the bottom.

19 Claims, 18 Drawing Sheets

(NUMBER OF SHAPE PARAMETERS IS 3)

(NUMBER OF SHAPE PARAMETERS IS 4)

(NUMBER OF SHAPE PARAMETERS IS 5)

ANTENNA AND INFORMATION COMMUNICATION APPARATUS USING THE ANTENNA

BACKGROUND OF THE INVENTION

1. Field of the Invention

The present invention relates to an antenna technology that can be used for information communication apparatuses including mobile communication apparatuses, small information terminals and other radio apparatuses. More particularly, the present invention relates to an antenna that can perform transmitting/receiving at wide bands, can be used in low frequency bands, and that is small and light. In addition, the present invention relates to an information communication apparatus using the antenna.

2. Description of the Related Art

In recent years, products that utilize radio technology are being widely used as the development of the radio communication technology has surged forward. As for the radio apparatus such as the mobile communication terminal, it is strongly required to downsize the antenna as the radio apparatus is downsized.

In addition, development of a wide-band and small antenna is expected for supporting plural communication schemes and for supporting wide band transmission such as UWB (Ultra Wide Band).

FIG. 1 shows a configuration of a conventional discone antenna. The discone antenna is a monopole antenna including a disc-like base plate (grounded conductor) 101 and a cone-like radiating element 102.

An ideal discone antenna is one that has an infinite size and does not have dependency on frequency. However, since an actual discone antenna has a finite size, an upper limit of an operating wavelength is limited to about four times the length of the radiating element.

A conventional example of such an in-horizontal-plane nondirectional antenna formed with the grounded conductor and the radiating element is described in the following, in which the following example is modified for realizing wide-band communication.

FIGS. 2A and 2B show an antenna disclosed in Japanese Laid-Open Patent application No. 09-083238 (Patent document 1), in which FIG. 2A shows a perspective view of the antenna and FIG. 2B shows a side elevation view of the antenna.

This antenna includes a skirt part 110 and a top load part 120. The skirt part 110 includes a cone base 111 in which spiral conductive elements 112 (112*a*, 112*b*) are formed on the outside surface of the cone base 111. The top load part 120 includes a plane base 121 placed near the top of the skirt part 110 in which a meander-like conductive element 122 is formed on the surface of the plane base 121. Power is supplied from a feeder 130.

In the antenna, the shape of the meander-like conductive element 122 on the plane base 121 is relatively wide beltlike. In addition, the antenna can realize multiple resonance due to existence of plural meander lines. Thus, the antenna is configured to perform wide-band communication.

In addition, the antenna can realize an electrical length longer than its appearance due to the spiral conductive elements 112 (112*a*, 112*b*) formed on the skirt part 110. Thus, the size of the antenna can be reduced compared with a conventional discone antenna.

However, as for this antenna, it is necessary to form the meander-like and spiral-like conductive patterns on the base, and it is necessary to increase density of the conductive patterns as wider-band is required. Therefore, there is a problem in that the structure of the antenna is complicated.

FIGS. 3A and 3B show an antenna disclosed in Japanese Laid-Open Patent application No. 09-153727 (Patent document 2), in which FIG. 3A shows a front view of the antenna and FIG. 3B shows a bottom view of the antenna.

This antenna includes a conductor 144 that is a radiating element and a metal plane base plate 143 that is a reflector plate. The outside surface of the radiating element is shaped like a body of semiellipse revolution or shaped like a semiround body, and the top of the conductor 144 is attached to the plane base plate 143 using a coaxial connector 142.

By adopting the body of semiellipse revolution or the semiround body as the shape of the radiating element, this antenna is downsized and is adapted to wide-band communication. However, for realizing wider-band communication so as to be able to use lower frequency, the size of the antenna needs to be increased.

As mentioned above, according to the conventional antenna, the antenna structure is complicated in order to realize wide-band communication, and the size of the antenna needs to be increased in order to adapt the antenna to lower frequency band.

SUMMARY OF THE INVENTION

A general object of the present invention is to provide a small and wide-band antenna having a simplified structure, and to provide an information communication apparatus using the antenna.

More particularly, an object of the present invention is to downsize the antenna by widening the frequency band that can be used by the antenna to low frequency side.

Another object of the present invention is to reduce weight of the antenna in addition to achieving the above-mentioned object.

Another object of the present invention is to improve impact resistance of the radiating element in addition to achieving the above-mentioned object.

Another object of the present invention is to manufacture the antenna at low cost.

The general object is achieved by an antenna including:

a grounded conductor; and a radiating element having a diameter that increases from the top of the radiating element to the bottom of the radiating element, the top of the radiating element being opposed to the grounded conductor, wherein the radiating element includes three regions positioned from the top to the bottom, each region having an angle between a side of the radiating element in the region and a center axis of the radiating element, wherein the angles of the three regions satisfy relationship: $\theta 1>\theta 2$ and $\theta 2<\theta 3$ when the angles are indicated by $\theta 1$, $\theta 2$ and $\theta 3$ respectively from the top to the bottom. The shape of the radiating element may be cone-like, multiple-sided pyramid-like or irrotational body-like.

According to the present invention, since the usable frequency band can be widened to the low frequency side, the antenna can be downsized. In addition, by using the antenna in an information communication apparatus, the information communication apparatus becomes small and convenient.

In the antenna, the radiating element or the grounded conductor may be formed with liner conductors. By using such liner conductors as the radiating element, the weight of the antenna can be decreased.

The antenna may be configured such that a dielectric member covers the radiating element of the antenna. By adopting such a structure, the propagation wavelength of the electromagnetic wave can be decreased so that the frequency band that can be used by the antenna can be widened to the low frequency side without increasing complexity of the structure of the antenna. Therefore, the antenna can be downsized. In addition, since the radiating element can be firmly fixed, there is an effect in that impact resistance of the radiating element increases.

In the antenna, the radiating element or the grounded conductor may be structured with a conductive metal film formed on an outer surface of a dielectric that may be hollow. By adopting this structure, the weight of the antenna can be decreased and the antenna can be manufactured at low cost.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

In the following, embodiments of the present invention is described with reference to figures.

[First Embodiment]

Figure 4:
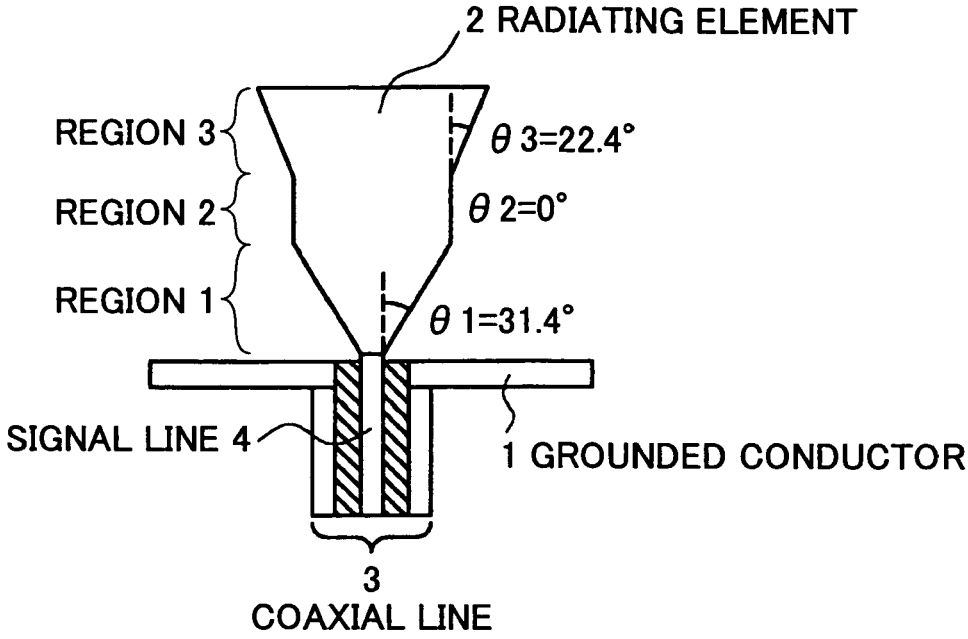
FIG. 4 is a block diagram of an antenna according to a first embodiment of the present invention.

FIG. 4 shows a section view of an antenna according to the first embodiment. The antenna of the present embodiment includes a grounded conductor 1 and a roughly cone-like radiating element 2. Power is supplied to the antenna via a signal line 4 in a coaxial line 3.

The diameter of the radiating element 2 increases from the top of the radiating element 2 to the bottom of the radiating element 2, and the top of the radiating element 2 is opposed to the grounded conductor 1. As shown in FIG. 4, the radiating element 2 includes three regions positioned from the top to the bottom. Each region has an angle between a side of the radiating element 2 in the region and a center axis of the radiating element 2, and the angles are indicated by $\theta 1$, $\theta 2$ and $\theta 3$ respectively from the top to the bottom. Each part at which the angle changes between two regions forms an angle changing part. In this embodiment, $\theta 1=31.4°$, $\theta 2=0°$ and $\theta 3=22.4°$. That is, the angles $\theta 1$, $\theta 2$ and $\theta 3$ of the three regions satisfy relationship: $\theta 1>\theta 2$ and $\theta 2<\theta 3$. In this embodiment, the grounded conductor 1 and the radiating element 2 are mainly formed of copper.

An operation of the antenna having the above-mentioned configuration is described in the following.

Figure 1:
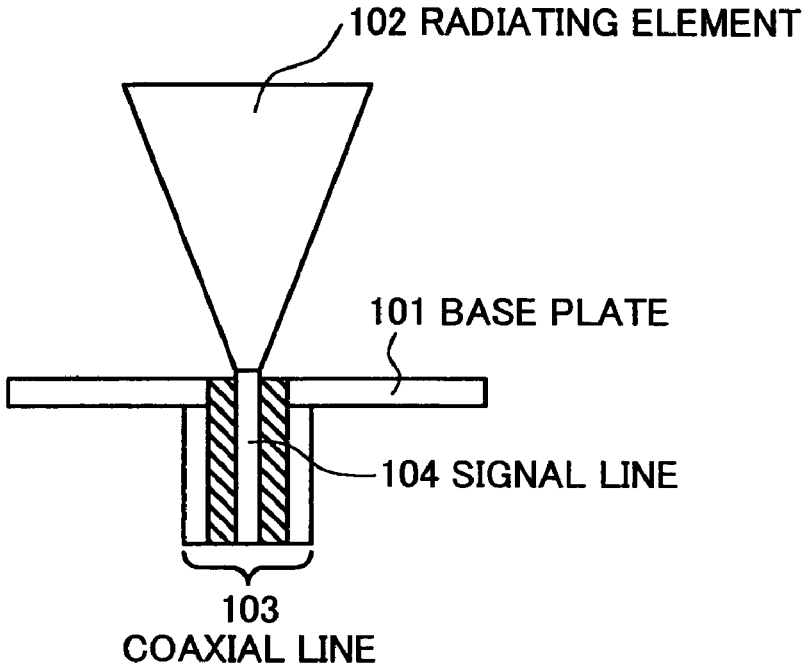
FIG.1 PRIOR ART
FIG. 1 is a structural drawing showing a configuration of a conventional discone antenna.
Figure 2A:
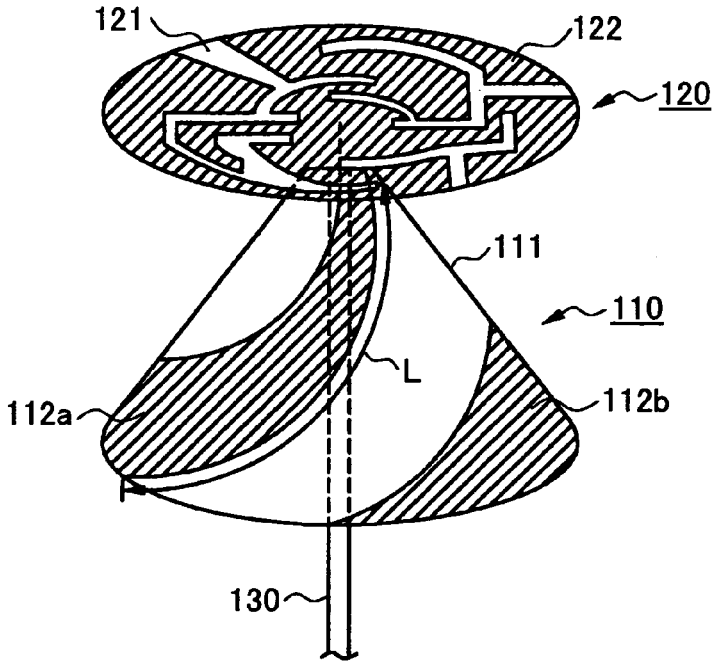
FIG.2A PRIOR ART
FIGS. 2A and 2B are structural drawings showing an antenna disclosed in Japanese Laid-Open Patent application No. 09-083238.
Figure 2B:
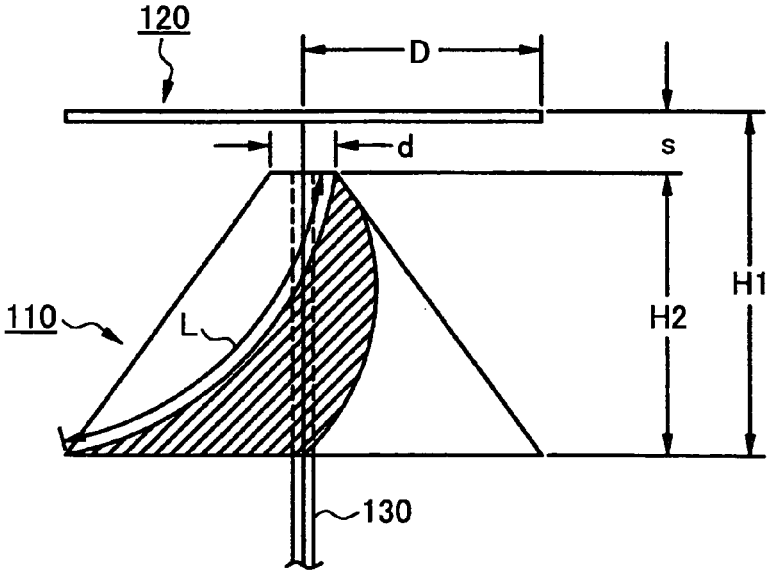
FIG.2B PRIOR ART
Figure 3A:
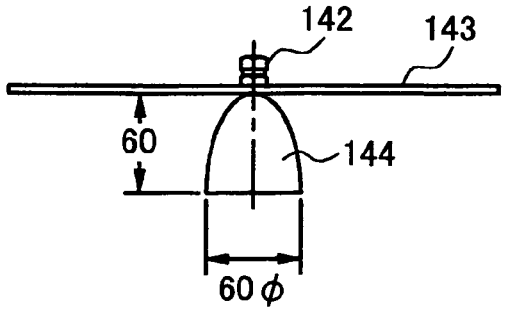
FIG.3A PRIOR ART
FIGS. 3A and 3B are block diagrams showing an antenna disclosed in Japanese Laid-Open Patent application No. 09-153727.
Figure 3B:
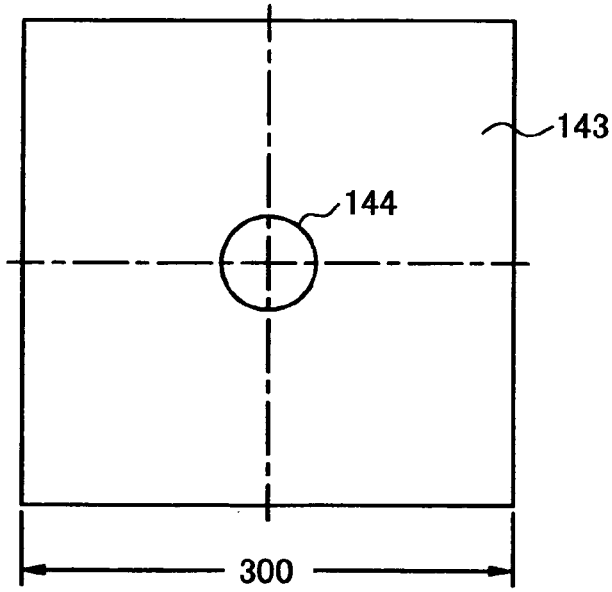
FIG.3B PRIOR ART
Figure 5:
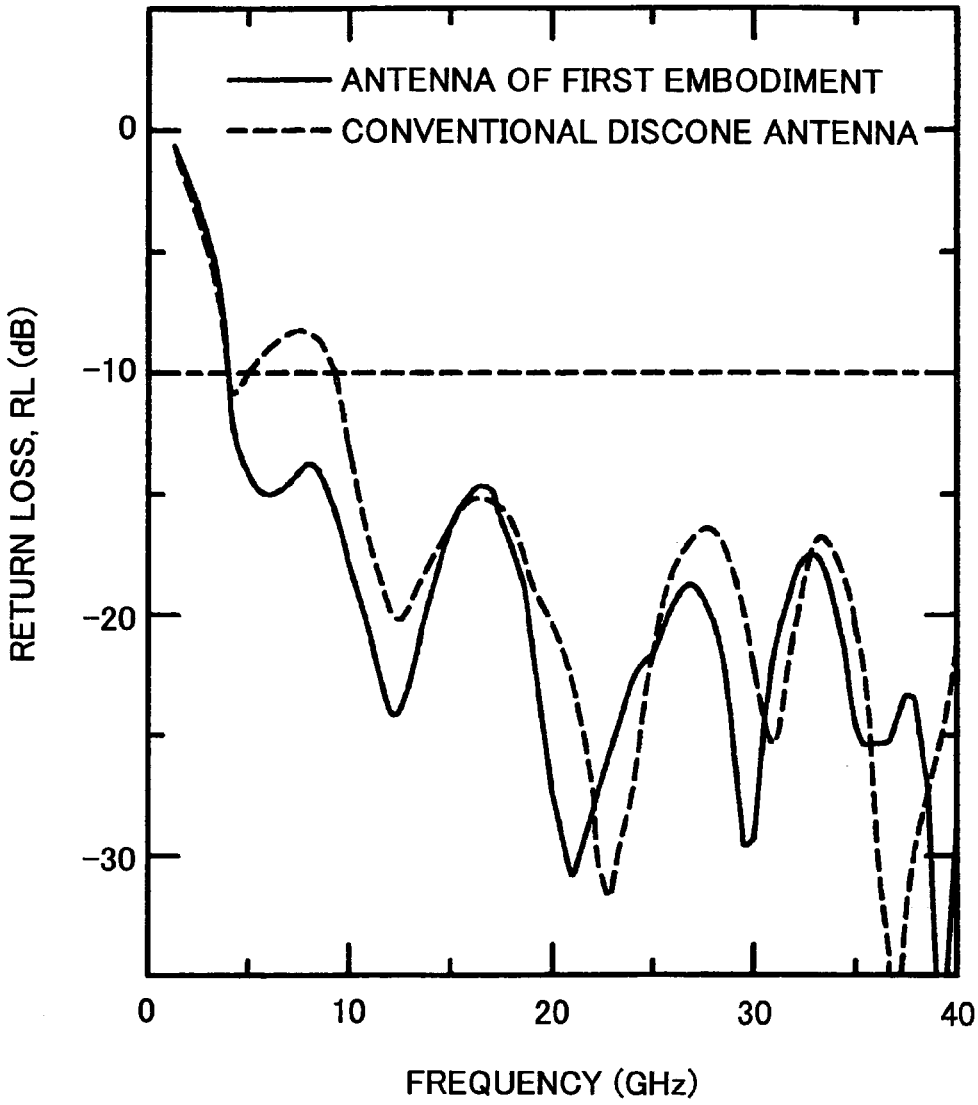
FIG. 5 shows return loss—frequency characteristics of the antenna of the first embodiment.

FIG. 5 shows return loss—frequency characteristics of the antenna of the present embodiment. In the figure, return loss—frequency characteristics of a conventional discone antenna ($\theta 1=\theta 2=\theta 3$, refer to FIG. 1) are also shown by dotted lines wherein the radius and the height of the conventional discone antenna are the same as those of the antenna of the present embodiment.

As shown in the figure, as for the antenna of the present embodiment, a lower limit of the frequency by which the return loss is equal to or less than −10 dB is 4.12 GHz that is lower than 9.04 GHz for the conventional discone antenna.

As is apparent from this embodiment, by using the radiating element having the shape of the present invention (having relationship: $\theta 1>\theta 2$ and $\theta 2<\theta 3$), the frequency band that can be used by the antenna is widened to the low frequency side, so that the antenna can be downsized.

Figure 6:
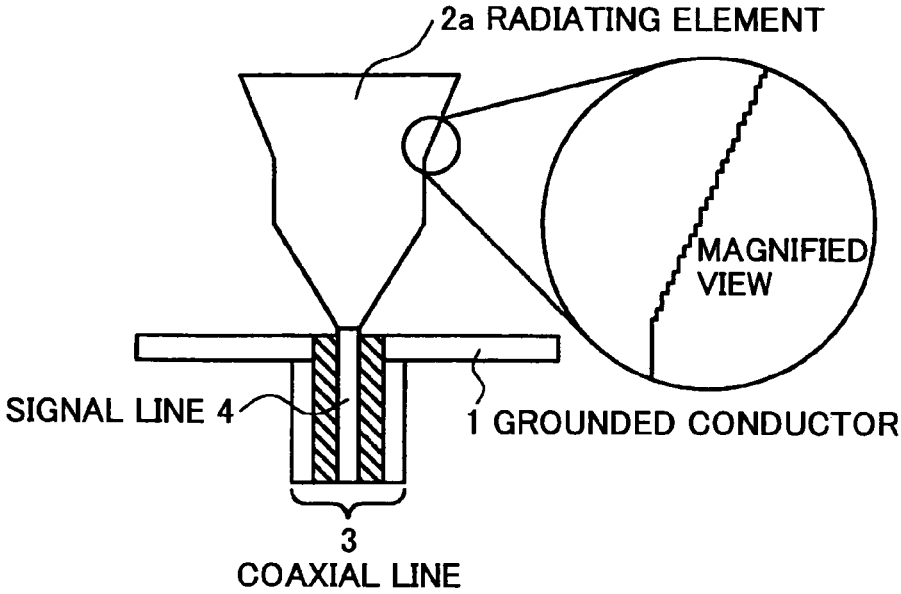
FIG. 6 shows a magnified view of a part of the radiating element of a modified example of the first embodiment.

The present invention is effective even though the surface of the radiating element is not smooth. FIG. 6 shows a modified example of the first embodiment. FIG. 6 also shows a magnified view of a part of the radiating element of the antenna.

Even though the radiating element has a stepped surface as shown in the magnified view in FIG. 6, the antenna is within the scope of the present invention and the effect of the above-mentioned embodiment can be obtained as long as the overall shape satisfies the relationship: θ1>θ2 and θ2<θ3.

Figure 7:
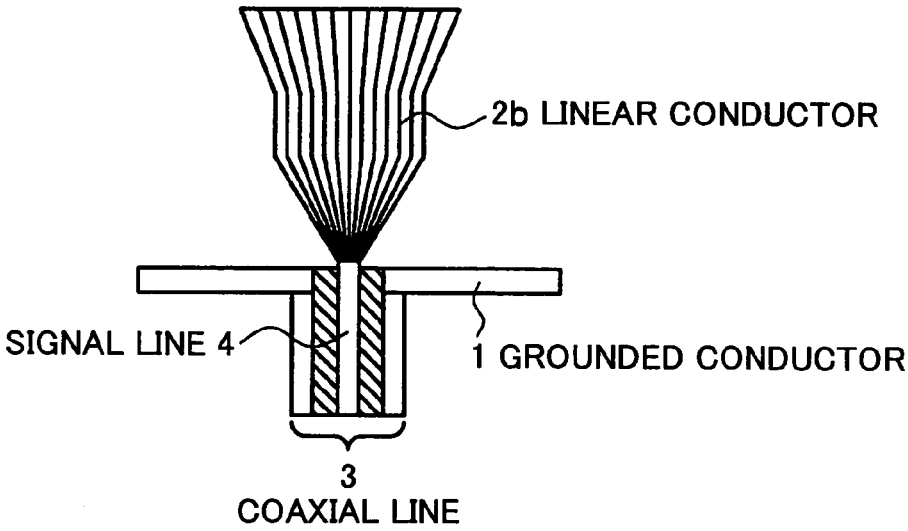
FIG. 7 is a structural drawing of an antenna according to the first embodiment of the present invention.

In addition, even when the radiating element of the antenna is formed with linear conductors as shown in FIG. 7, the above-mentioned effect can be obtained. In addition, according to the structure shown in FIG. 7, the weight of the antenna can be decreased.

Figure 8A:
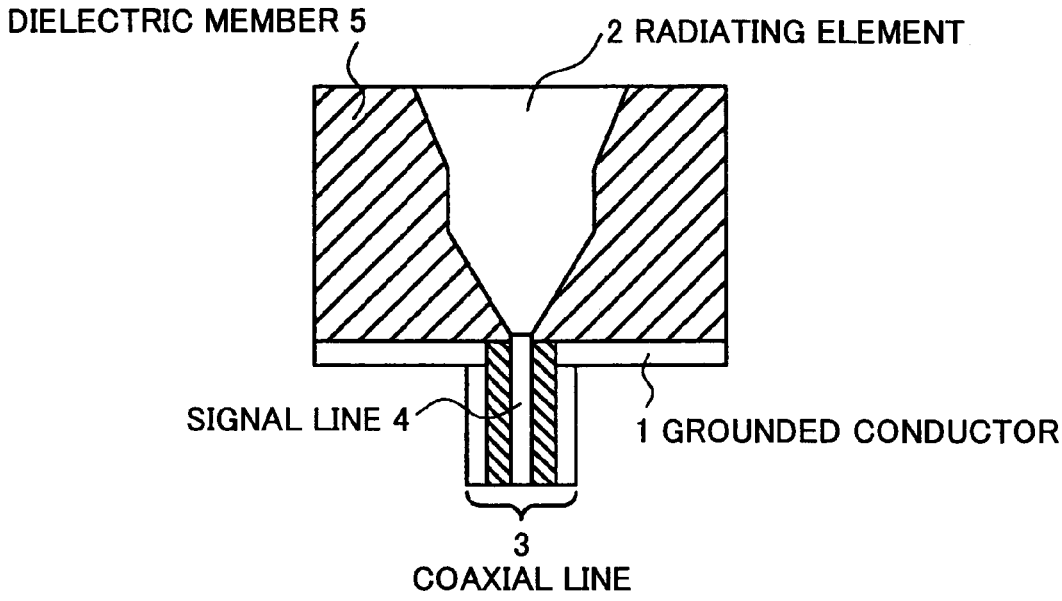
FIG. 8A is a structural drawing of an antenna according to the first embodiment of the present invention.
Figure 8B:
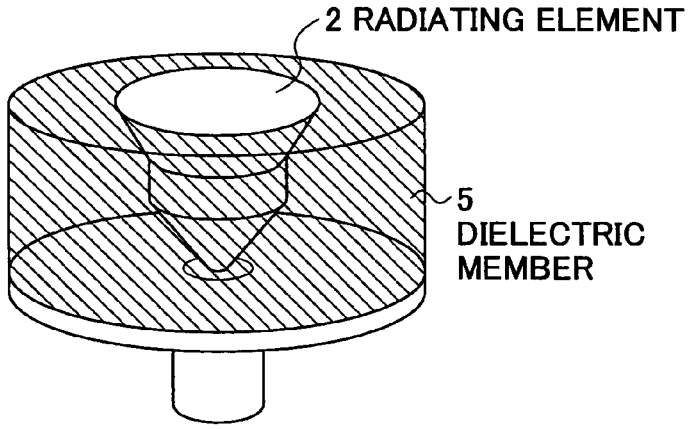
FIG. 8B shows a perspective view of the antenna shown in FIG. 8A.

In addition, as shown in FIG. 8A, the antenna can be configured such that a dielectric member 5 covers the radiating element 2 of the antenna. FIG. 8B shows a perspective view of the antenna. By adopting such a structure, the propagation wavelength of the electromagnetic wave can be decreased so that the frequency band that can be used by the antenna can be widened to the low frequency side without increasing complexity of the structure of the antenna. Therefore, the antenna can be downsized. In addition, since the radiating element 2 can be firmly fixed to the grounded conductor 1, there is an effect in that impact resistance of the radiating element increases.

[Second Embodiment]

Figure 9:
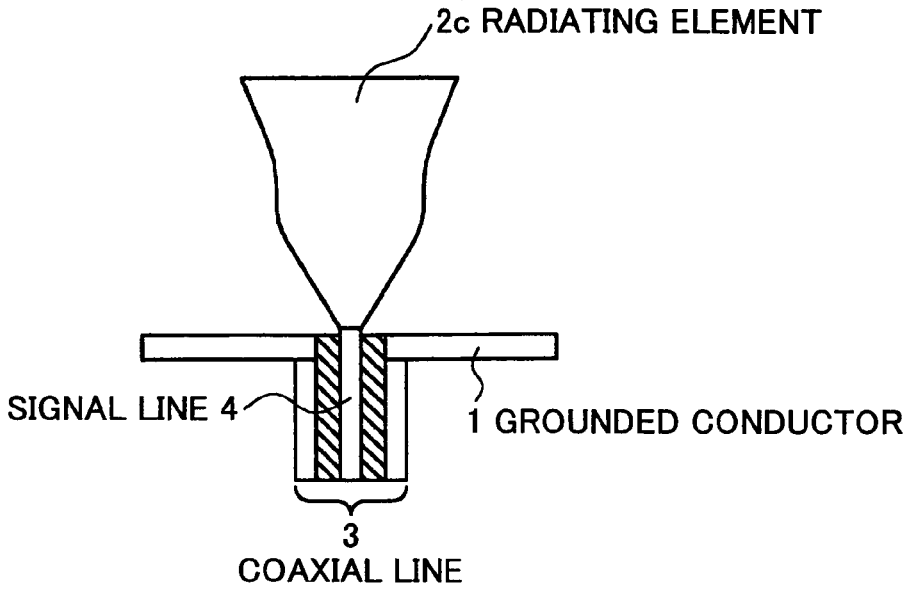
FIG. 9 is a structural drawing of an antenna according to a second embodiment of the present invention.

FIG. 9 is a section view of an antenna of the second embodiment of the present invention. The antenna of the present embodiment includes a grounded conductor (base plate) 1 and a cone-like radiating element 2*c*, in which power is supplied via a signal line 4 in a coaxial line 3.

As shown in the figure, the shape of the radiating element 2*c* of the present embodiment is different from that of the first embodiment in that each of angle changing parts between θ1 and θ2 and between θ2 and θ3 is smoothed as shown in FIG. 9.

Figure 10:
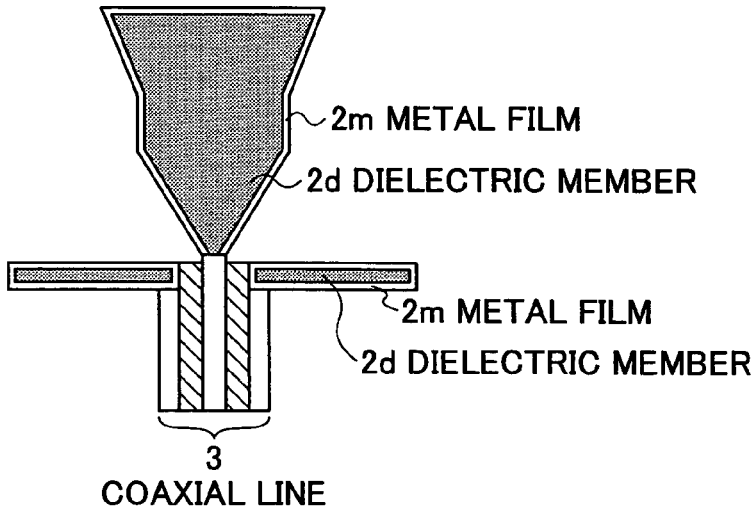
FIG. 10 is a structural drawing of an antenna in which each of the grounded conductor (base plate) and the radiating element is formed with a metal film that is formed on a dielectric.
Figure 11:
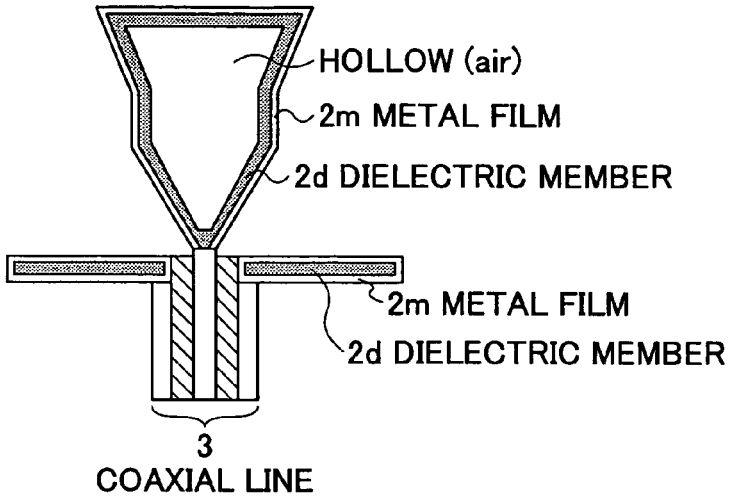
FIG. 11 is a structural drawing of an antenna in which the grounded conductor is formed with a metal film that is formed on a hollow dielectric.

In addition, each of the grounded conductor (base plate) 1 and the radiating element 2*c* in the present embodiment can be formed with a metal film that is formed on a dielectric. Accordingly, the weight of the antenna can be decreased and the antenna can be manufactured at low cost. This structure can be also adopted for other embodiments. FIG. 10 shows an example in which the above-mentioned structure is applied for the first embodiment. As shown in the figure, the radiating element is formed with a metal film 2*m* that is formed on a dielectric member 2*d*. As shown in FIG. 11, the dielectric member 2*d* for forming the radiating element can be hollow.

Even though the angle changing parts on the side of the radiating element are smoothed as shown in FIG. 9 in the present embodiment, the antenna is within the scope of the present invention as long as the overall shape of the antenna has the relationship: θ1>θ2 and θ2<θ3, and the effect same as the first embodiment can be obtained in this embodiment.

Also according to the present embodiment, since the frequency band that can be used by the antenna can be widened to the low frequency side, the antenna can be downsized.

[Third Embodiment]

Figure 12:
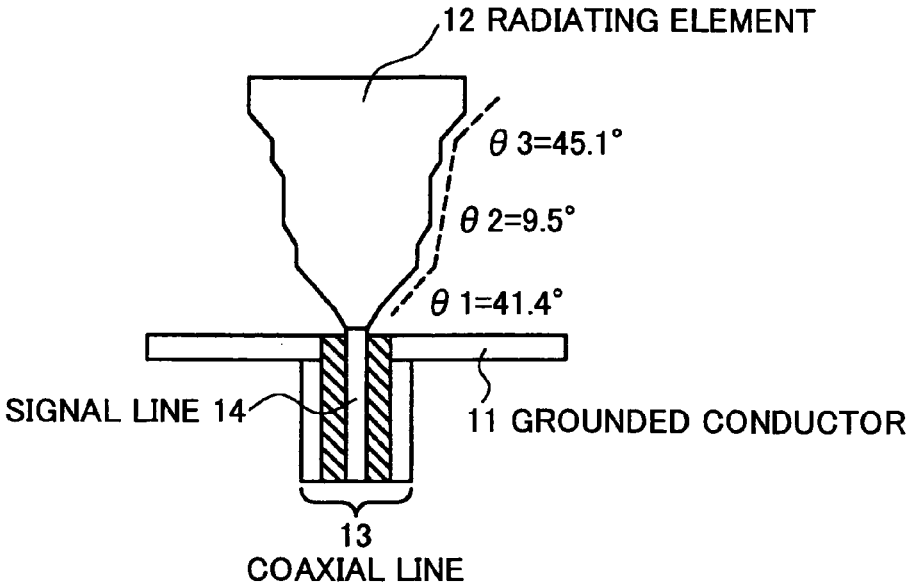
FIG. 12 is a structural drawing of an antenna according to a third embodiment of the present invention.

FIG. 12 shows a section view of an antenna of the third embodiment of the present invention. The antenna of the present embodiment includes a grounded conductor (base plate) 11 and a cone-like radiating element 12, in which power is supplied via a signal line 14 in a coaxial line 13. As shown in FIG. 12, an angle between a side of the radiating element 12 and a center axis of the radiating element 12 changes multiple times from the top to the bottom of the radiating element 12.

The dotted line shown in FIG. 12 is an envelope of the side of the radiating element. With respect to the envelope, the shape of the radiating element 12 includes three regions positioned from the top side to the bottom side. Each region has an angle between the envelope in the region and the center axis of the radiating element 12. The angles are θ1, θ2 and θ3 from the top to the bottom, wherein θ1=41.4°, θ2=9.5° and θ3=45.1° in the present embodiment.

The angles have relationship: θ1>θ2 and θ2<θ3. Also in this embodiment, each of the grounded conductor (base plate) 11 and the radiating element 12 can be configured with a metal film formed on a hollow dielectric. By configuring the antenna using the metal film formed on the hollow dielectric, the weight of the antenna can be decreased and the antenna can be manufactured at low cost.

Next, an operation of the antenna having the above-mentioned configuration is described in the following.

Figure 13:
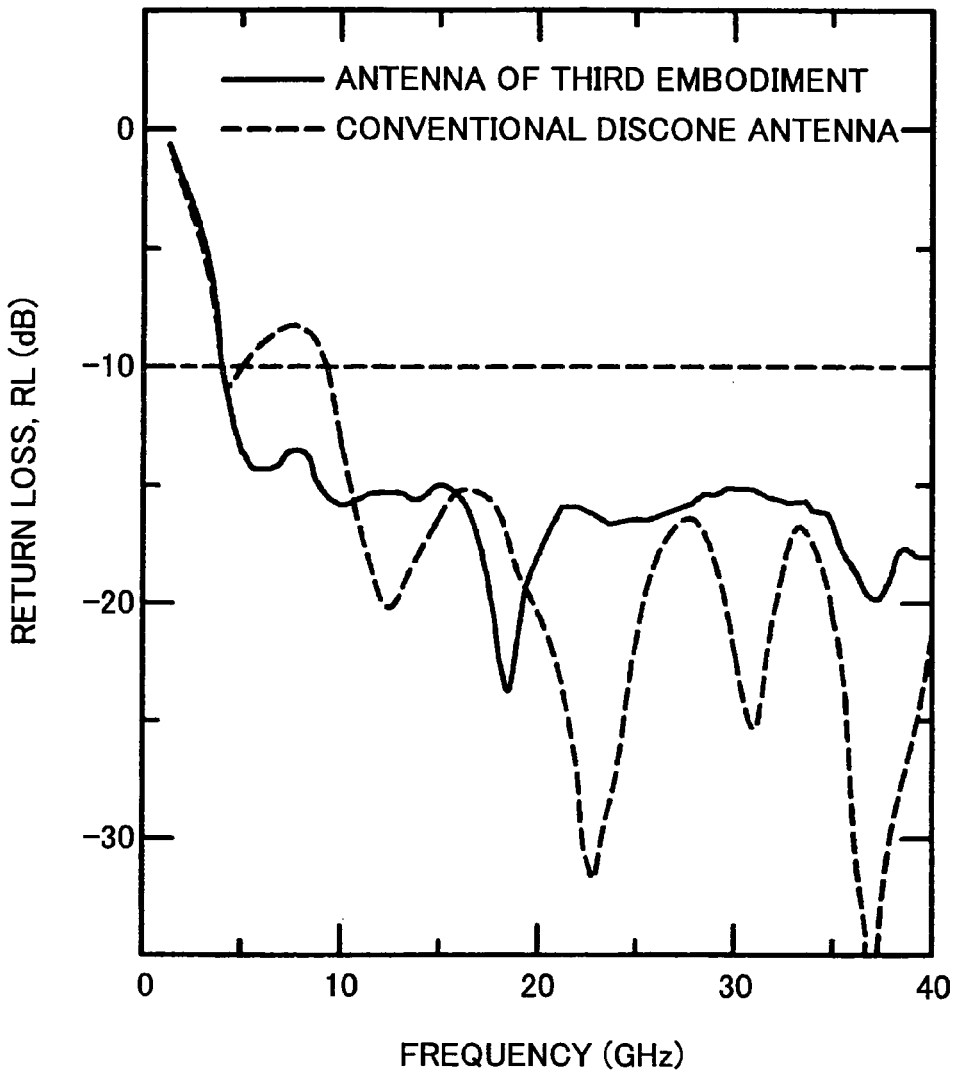
FIG. 13 shows return loss—frequency characteristics of the antenna of the third embodiment.

FIG. 13 shows return loss—frequency characteristics of the antenna of the present embodiment. In the figure, return loss—frequency characteristics of a conventional discone antenna (θ1=θ2=θ3, refer to FIG. 1) are also shown by dotted lines wherein the radius and the height of the conventional antenna are the same as those of the antenna of the present embodiment.

As shown in the figure, as for the antenna of the present embodiment, a minimum frequency by which the return loss is equal to or less than −10 dB is 4.12 GHz that is lower than 9.04 GHz for the conventional discone antenna.

As is apparent from this embodiment, by applying the present invention, since the frequency band that can be used by the antenna can be widened to the low frequency side, the antenna can be downsized.

[Fourth Embodiment]

Figure 14:
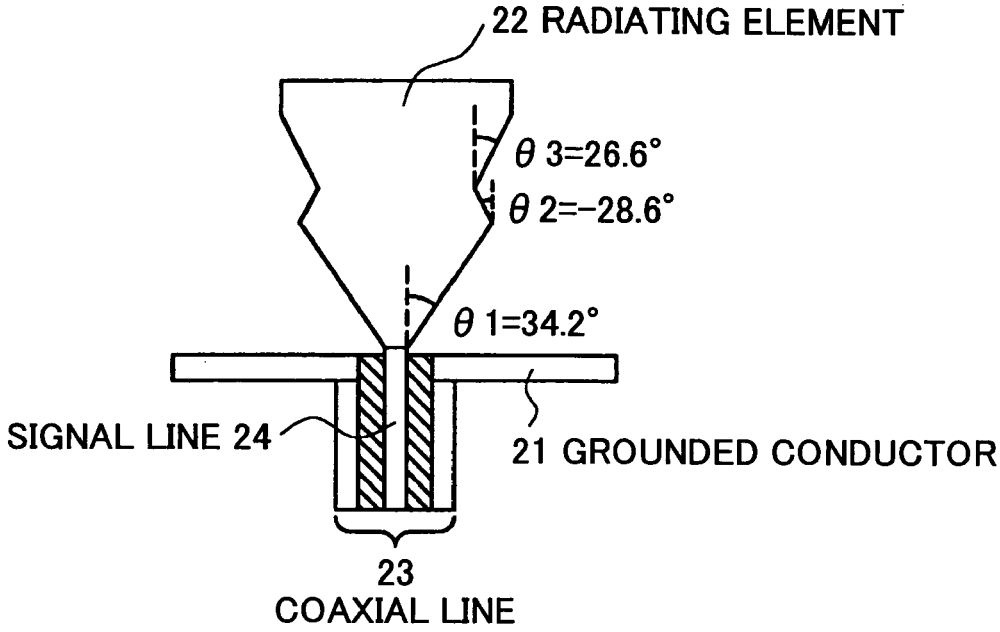
FIG. 14 is a structural drawing of an antenna according to a fourth embodiment of the present invention.

FIG. 14 shows a section view of an antenna of the fourth embodiment of the present invention. The antenna of the present embodiment includes a grounded conductor 21 and a roughly cone-like radiating element 22, in which power is supplied via a signal line 24 in a coaxial line 23.

The shape of the radiating element 22 of the present embodiment includes three regions positioned from the top side to the bottom side. Each region has an angle between a side of the radiating element 22 in the region and the center axis of the radiating element 22. The angles of the regions are θ1, θ2 and θ3 respectively from the top to the bottom, wherein θ1=34.2°, θ2=−28.6° and θ3=26.6° in the present embodiment. The angles have relationship: θ1>θ2 and θ2<θ3. The grounded conductor (base plate) 21 and the radiating element 22 is mainly formed with copper.

Next, an operation of the antenna having the above-mentioned configuration is described in the following.

Figure 15:
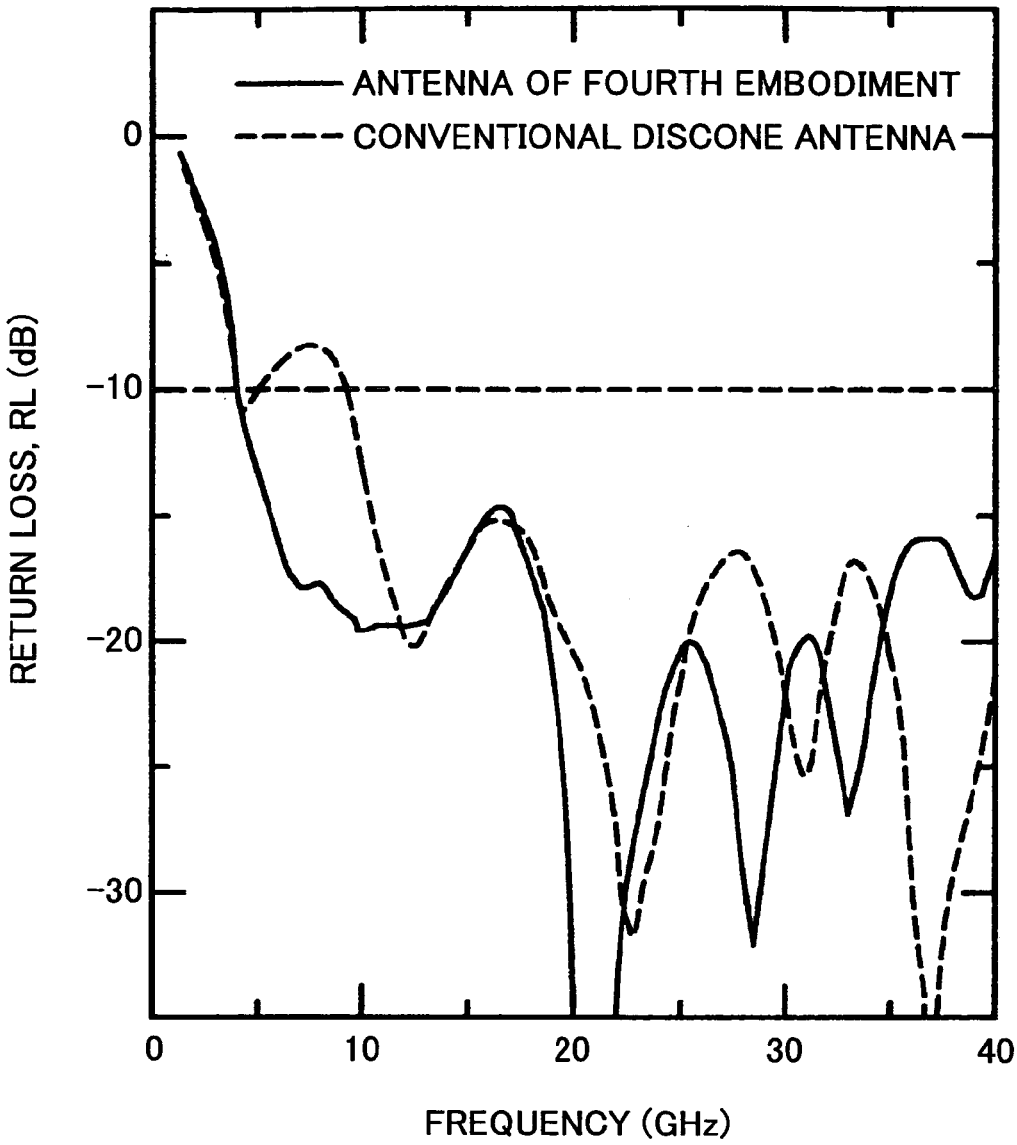
FIG. 15 shows return loss—frequency characteristics of the antenna of the fourth embodiment.

FIG. 15 shows return loss—frequency characteristics of the antenna of the present embodiment. In the figure, return loss—frequency characteristics of a conventional discone antenna (θ1=θ2=θ3, refer to FIG. 1) are also shown by dotted lines wherein the radius and the height of the conventional antenna are the same as those of the antenna of the present embodiment.

As shown in the figure, as for the antenna of the present embodiment, a minimum frequency by which the return loss is equal to or less than −10 dB is 4.29 GHz that is lower than 9.04 GHz for the conventional discone antenna.

As is apparent from this embodiment, by applying the present invention, since the frequency band that can be used by the antenna can be widened to the low frequency side, the antenna can be downsized.

[Fifth Embodiment]

Figure 16:
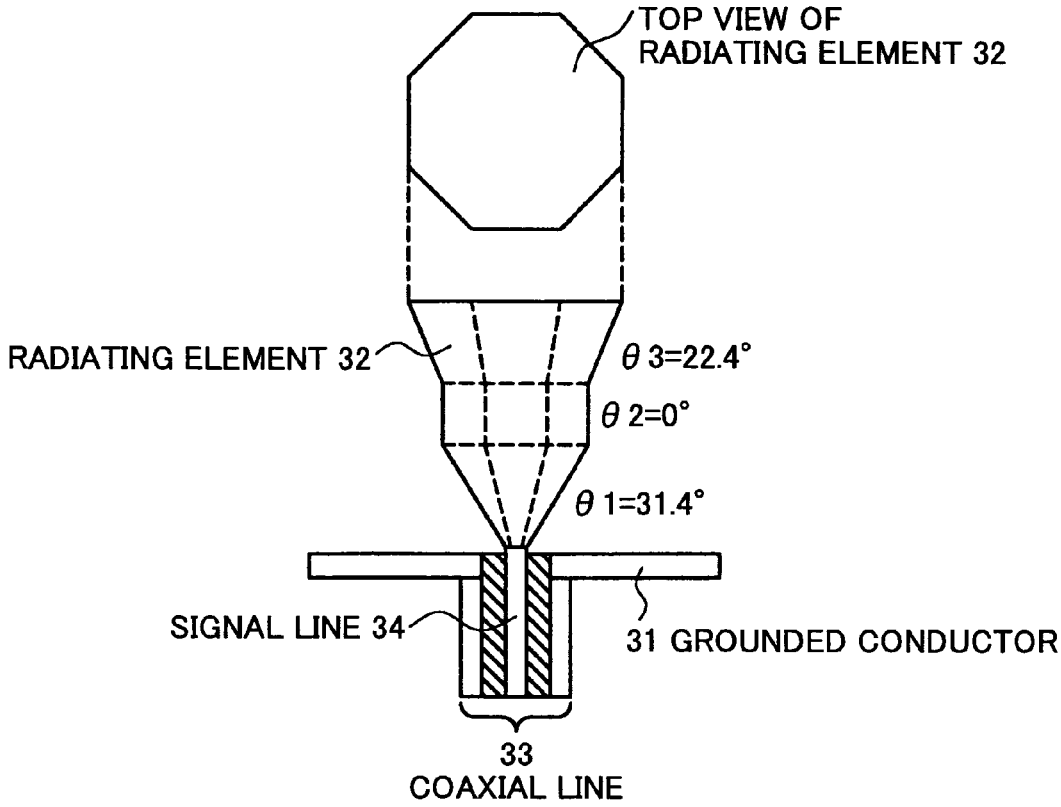
FIG. 16 is a structural drawing of an antenna according to a fifth embodiment of the present invention.

FIG. 16 shows a section view of an antenna and a top view of a radiating element of the antenna according to the fifth embodiment of the present invention. The antenna of the present embodiment includes a grounded conductor (base plate) 31 and a eight sided pyramid-like radiating element 32, in which power is supplied via a signal line 34 in a coaxial line 33.

The shape of the radiating element 32 of the present embodiment includes three regions positioned from the top side to the bottom side. Each region has an angle between a side of the radiating element 32 in the region and the center axis of the radiating element 32. The angles of the regions are θ1, θ2 and θ3 respectively from the top to the bottom, wherein θ1=31.4°, θ2=0° and θ3=22.4° in the present embodiment. That is, the angles have relationship: θ1>θ2 and θ2<θ3. The grounded conductor (base plate) 31 and the radiating element 32 is mainly formed with copper.

Even though the shape of the radiating element 32 is multiple-sided pyramid-like in the present embodiment, the antenna is within the scope of the present invention as long as the shape has the relationship: θ1>θ2 and θ2<θ3, and an effect the same as that obtained by the roughly cone-like radiating element shown in first to fourth embodiments can be obtained.

As is apparent from this embodiment, by applying the present invention, since the frequency band that can be used by the antenna can be widened to the low frequency side, the antenna can be downsized.

[Sixth Embodiment]

Figure 17:
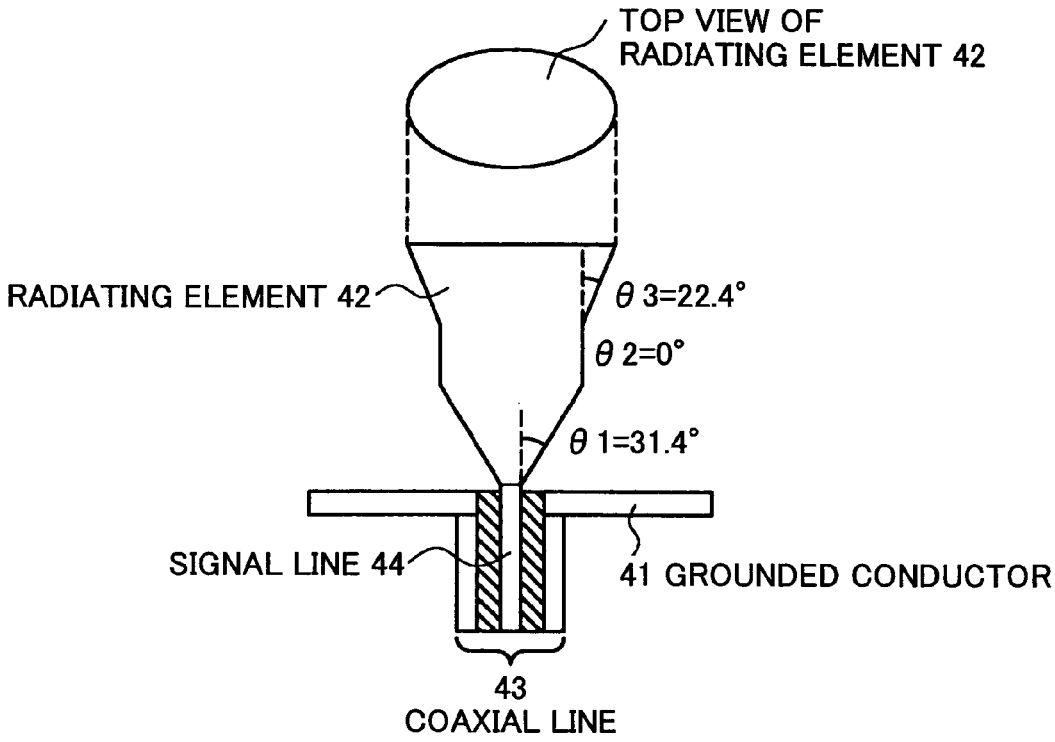
FIG. 17 is a structural drawing of an antenna according to a sixth embodiment of the present invention.

FIG. 17 shows a section view of an antenna and a top view of a radiating element of the antenna according to the sixth embodiment of the present invention.

The antenna of the present embodiment includes a grounded conductor (base plate) 41 and an elliptic cone-like radiating element 42, in which power is supplied via a signal line 44 in a coaxial line 43.

The shape of the radiating element 42 of the present embodiment includes three regions positioned from the top side to the bottom side. Each region has an angle between a side of the radiating element 42 in the end side of the major axis of the eclipse and the center axis of the radiating element 42. The angles of the regions are θ1, θ2 and θ3 respectively from the top to the bottom, wherein θ1=31.4°, θ2=0° and θ3=22.4° in the present embodiment. The angles have relationship: θ1>θ2 and θ2<θ3. The grounded conductor (base plate) 41 and the radiating element 42 is mainly formed with copper as the material.

Even when the shape of the radiating element is an irrotational body like the elliptic cone in the present embodiment, the antenna is within the scope of the present invention as long as the overall shape has the relationship: θ1>θ2 and θ2<θ3, and an effect the same as that obtained by the roughly cone-like radiating element shown in first to fourth embodiments can be obtained.

As is apparent from this embodiment, by applying the present invention, since the frequency band that can be used by the antenna can be widened to the low frequency side, the antenna can be downsized.

[Seventh Embodiment]

Figure 18:
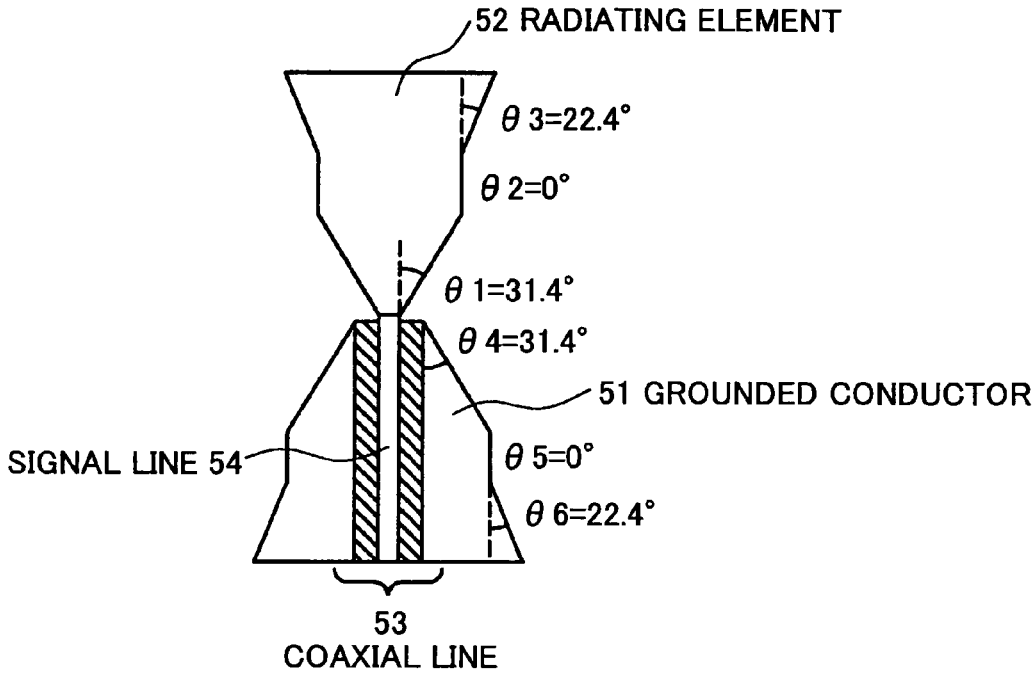
FIG. 18 is a structural drawing of an antenna according to a seventh embodiment of the present invention.

FIG. 18 shows a section view of an antenna according to the seventh embodiment of the present invention. The antenna of the present embodiment includes a roughly cone-like grounded conductor (base plate) 51 and a roughly cone-like radiating element 52, in which power is supplied via a signal line 54 in a coaxial line 53.

The shape of the radiating element 52 of the present embodiment includes three regions positioned from the top side to the bottom side. Each region has an angle between a side of the radiating element 52 in the region and the center axis of the radiating element 52. The angles of the regions are θ1, θ2 and θ3 respectively from the top to the bottom, wherein θ1=31.4°, θ2=0° and θ3=22.4° in the present embodiment. The angles have relationships: θ1>θ2 and θ2<θ3.

The shape of the grounded conductor 51 of the present embodiment includes three regions positioned from the top side to the bottom side. Each region has an angle between a side of the grounded conductor 51 in the region and the center axis of the grounded conductor 51. The angles of the regions are θ4, θ5 and θ6 respectively from the top to the bottom, wherein θ4=31.4°, θ5=0° and θ6=22.4° in the present embodiment. The angles have relationship: θ4>θ5 and θ5<θ6. The grounded conductor (base plate) 51 and the radiating element 52 of the present embodiment is mainly formed with copper as the material.

By adopting the configuration of the antenna of the present embodiment, since the frequency band that can be used by the antenna can be widened to the low frequency side, the antenna can be downsized.

[Eighth Embodiment]

Figure 19:
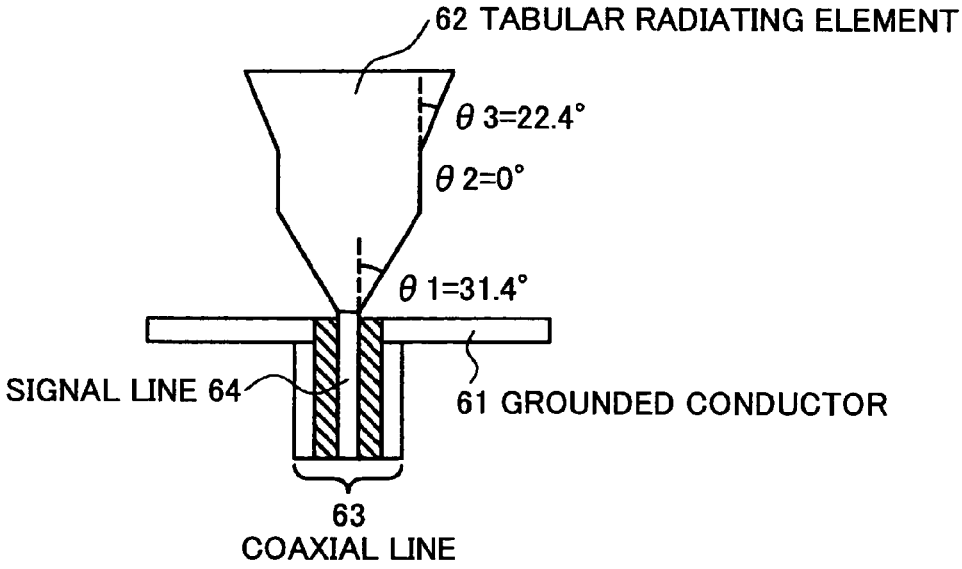
FIG. 19 is a structural drawing of an antenna according to a eighth embodiment of the present invention.

FIG. 19 shows a section view of an antenna according to the eighth embodiment of the present invention. The antenna of the present embodiment includes a grounded conductor (base plate) 61 and a tabular radiating element 62, in which power is supplied via a signal line 64 in a coaxial line 63.

The shape of the tabular radiating element 62 of the present embodiment includes three regions positioned from the top side to the bottom side. Each region has an angle between a side of the radiating element 62 in the region and the center axis of the radiating element 62. The angles of the regions are θ1, θ2 and θ3 respectively from the top to the bottom, wherein θ1=31.4°, θ2=0° and θ3=22.4° in the present embodiment. The angles have relationship: θ1>θ2 and θ2<θ3. The grounded conductor (base plate) 61 and the tabular radiating element 62 is mainly formed with copper as the material.

By adopting the configuration of the present embodiment, the frequency band that can be used by the antenna can be widened to the low frequency side, so that the antenna can be downsized.

Although the tabular radiating element 62 is placed perpendicular to the surface of the grounded conductor (base plate) 61 in this embodiment, a configuration in which the grounded conductor (base plate) 61 and the tabular radiating element 62 are opposed with each other in a plane can be adopted (which will be described as a ninth embodiment with reference to FIG. 20).

[Ninth Embodiment]

Figure 20:
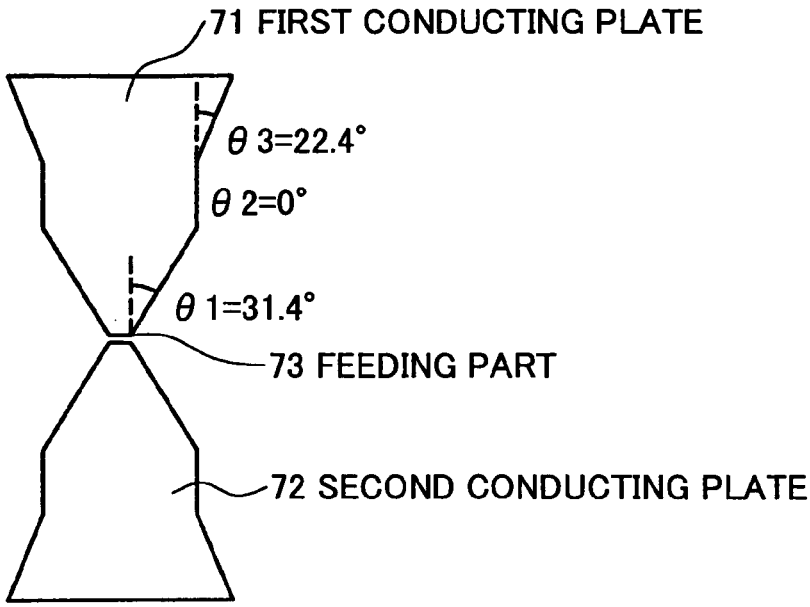
FIG. 20 is a structural drawing of an antenna according to a ninth embodiment of the present invention.

FIG. 20 shows a section view of an antenna according to the ninth embodiment of the present invention. The antenna of the present embodiment includes an isosceles triangle-like first conductive plate 71 and an isosceles triangle-like second conductive plate 72. The reference numeral 73 indicates a feeding part. This antenna is similar to a bowtie antenna.

The shape of the first conductive plate 71 of the present embodiment includes three regions positioned from the top side to the bottom side. Each region has an angle between a side of the first conductive plate 71 in the region and the center axis of the first conductive plate 71. The angles of the regions are θ1, θ2 and θ3 respectively from the top to the bottom, wherein θ1=31.4°, θ2=0° and θ3=22.4° in the present embodiment. The angles have relationship: θ1>θ2 and θ2<θ3. The shape of the second conductive plate 72 is the same as that of the first conductive plate 71.

By adopting the configuration of the present embodiment, since the frequency band that can be used by the antenna can be widened to the low frequency side, the antenna can be downsized.

In the following, discussion of shape parameters on the side of the radiating element is provided.

Figure 21:
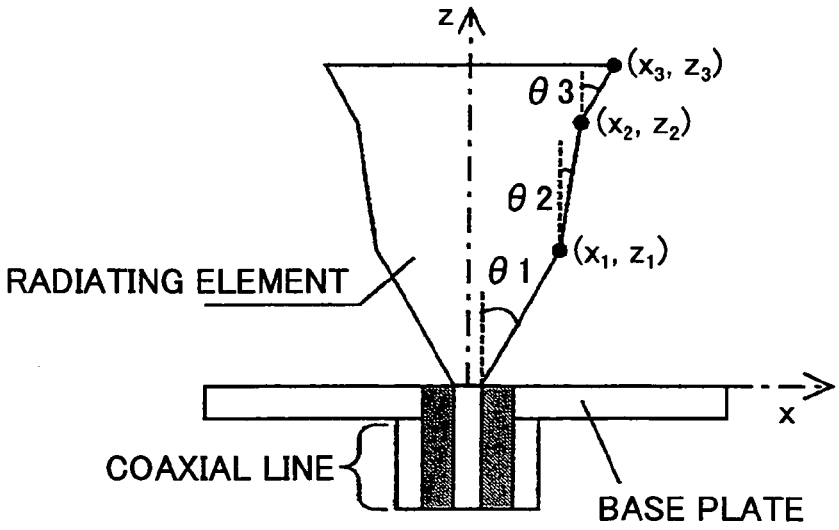
FIG. 21 is a structural drawing of an antenna in which the number of radiating element shape parameters is three.

The shape of the radiating element of the antenna of the present invention can be represented by using shape parameters that are coordinates (x1,z1), (x2,z2) and (x3,z3) of three points on the side of the radiating element as shown in FIG. 21.

Inventors of the present invention determined the shape parameters by using an optimization method in which return loss of the antenna obtained by electromagnetic field analysis is used as an evaluation value.

As a result, the inventors found that the frequency band usable by the antenna can be widened to the low frequency side when adopting the configuration having the relationship: $\theta 1>\theta 2$ and $\theta 2<\theta 3$ as the side shape of the radiating element.

Figure 22:
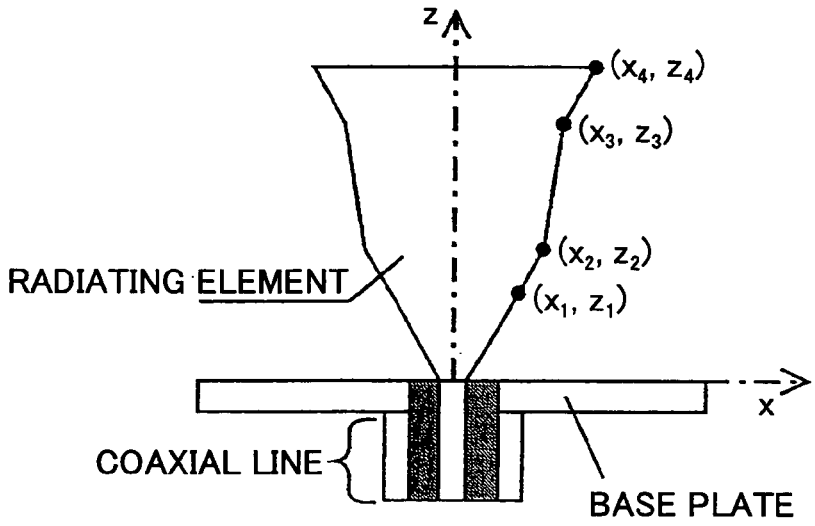
FIG. 22 is a structural drawing of an antenna in which the number of radiating element shape parameters is four.
Figure 23:
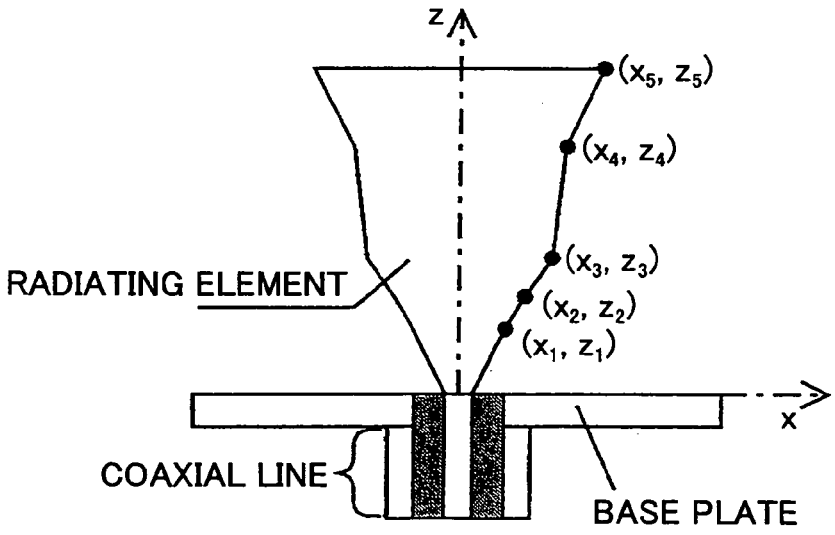
FIG. 23 is a structural drawing of an antenna in which the number of radiating element shape parameters is five.

In addition, the inventors of the antenna further investigated a case where the number of the shape parameters are increased so that shape flexibility is increased. FIG. 22 shows a case in which the number of the shape parameters of the radiating element is four, and FIG. 23 shows a case in which the number of the shape parameters of the radiating element is five. Each of the radiating elements is optimized such that return loss in the low frequency side is decreased.

In each of the antennas shown in the figures, the height of the radiating element is 15 mm, and the maximum diameter is 13.2 mm. As is apparent from FIGS. 22 and 23, even when the number of the parameters is increased from three to four or five, the radiating element shape obtained by optimization is nearly the same as that of the radiating element shape in which the number of the parameters is three (FIG. 21), and the antenna having the shape in which the number of the parameters is increased from three is also within the scope of the present invention.

Figure 24:
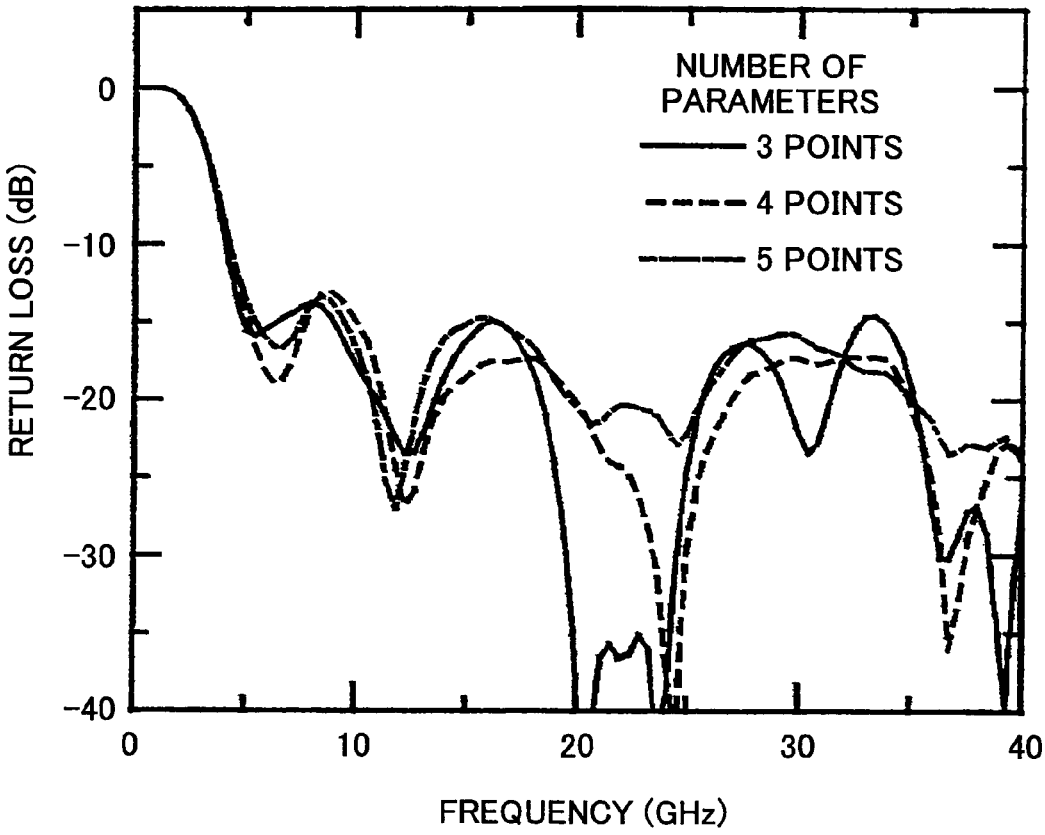
FIG. 24 shows return loss—frequency characteristics of antennas optimized with three shape parameters, four shape parameters and five shape parameters respectively.

FIG. 24 shows return loss—frequency characteristics of antennas designed with three shape parameters, four shape parameters and five shape parameters respectively. Nearly the same good frequency characteristics are shown for each of the antennas in which the return loss is equal to or less than −10 dB in frequencies equal to or greater than 4.2 GHz.

As mentioned above, even though the number of the shape parameters is increased from three to four or five, a radiating element shape nearly the same as that with three shape parameters can be obtained by optimization. Therefore, it is indicated that even when the number of the shape parameters of the radiating element is increased so that the shape flexibility is increased, the radiating element shape of the present invention is effective.

Figure 25:
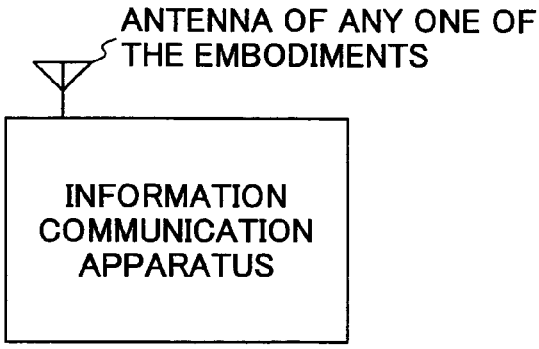
FIG. 25 shows an information communication apparatus with an antenna of any one of the embodiments.

By providing the antenna in any one of the first to eighth embodiments for an information communication apparatus such as a mobile communication apparatus as shown in FIG. 25, a small information terminal and other wireless apparatuses, a small and convenient information communication apparatus can be provided.

The present invention is not limited to the specifically disclosed embodiments, and variations and modifications may be made without departing from the scope of the present invention.

The present application contains subject matter related to Japanese patent application No. 2004-206124, filed in the JPO on Jul. 13, 2004, and Japanese patent application No. 2005-053142, filed in the JPO on Feb. 28, 2005, the entire contents of which are incorporated herein by reference.

What is claimed is:

1. An antenna comprising:

a grounded conductor; and a radiating element including first, second and third regions, with the first region positioned closest and opposed to the grounded conductor, the third region positioned furthest from the grounded conductor, and the second region positioned between said first and third regions, wherein a first diameter in said first region is smaller than a second diameter in said second region and a third diameter in said third region, and said second diameter in said second region is smaller than said third diameter in said third region, wherein each region has a corresponding angle between a side of the radiating element in the region and a center axis of the radiating element, and wherein $\theta 1$ is the angle in said first region, $\theta 2$ is the angle in said second region, $\theta 3$ is the angle in said third region, and $\theta 1>\theta 2$ and $\theta 2<\theta 3$.

2. The antenna as claimed in claim 1, wherein the shape of the radiating element is cone-like.

3. The antenna as claimed in claim 1, wherein the shape of the radiating element is multiple-sided pyramid-like.

4. The antenna as claimed in claim 1, wherein the shape of the radiating element is irrotational body-like.

5. The antenna as claimed in claim 4, wherein the shape of the radiating element is elliptic cone-like.

6. The antenna as claimed in claim 1, wherein the radiating element is shaped such that the angle changes smoothly from $\theta 1$ to $\theta 2$ or from $\theta 2$ to $\theta 3$.

7. The antenna as claimed in claim 1, wherein the shape of the grounded conductor is cone-like, multiple-sided pyramid-like or elliptic cone-like.

8. The antenna as claimed in claim 7, wherein the grounded conductor includes first, second and third portions, with the first portion positioned closest and opposed to the first region of the radiating element, the third portion positioned furthest from the first region of the radiating element, and the second portion positioned between said first and third portions, each portion having an angle between a side of the grounded conductor in the portion and a center axis of the grounded conductor, and wherein $\theta 4$ is the angle in the first portion, $\theta 5$ is the angle in said second portion, $\theta 6$ is the angle in said third portion, and $\theta 4>\theta 5$ and $\theta 5<\theta 6$.

9. The antenna as claimed in claim 1, wherein the radiating element or the grounded conductor is formed with liner conductors.

10. The antenna as claimed in claim 1, wherein the radiating element is surrounded with a dielectric member.

11. The antenna as claimed in claim 1, wherein the radiating element or the grounded conductor is structured with a conductive metal film formed on an outer surface of a dielectric.

12. The antenna as claimed in claim 11, wherein the dielectric is hollow.

13. An antenna comprising:

a grounded conductor; and a radiating element including first, second and third regions, with the first region positioned closest and opposed to the grounded conductor, the third region positioned furthest from the grounded conductor, and the second region positioned between said first and third regions, wherein a first diameter in said first region is smaller than a second diameter in said second region and a third diameter in said third region, and said second diameter in said second region is smaller than said third diameter in said third region, wherein the radiating element is shaped such that a first angle between a side of the radiating element and a center axis of the radiating element changes multiple times from the first region to the third region, wherein each region has a corresponding second angle between an envelope of the side of the radiating element in the region and the center axis of the radiating element, and wherein θ1 is the second angle in said first region, θ2 is the second angle in said second region, θ3 is the second angle in said third region, and θ1>θ2 and θ2<θ3.

14. An antenna comprising:

a grounded conductor;

and a tabular radiating element including first, second and third regions, with the first region positioned closest and opposed to the grounded conductor, the third region positioned furthest from the grounded conductor, and the second region positioned between said first and third regions, wherein a first width in said first region is smaller than a second width in said second region and a third width in said third region, and said second width in said second region is smaller than said third width in said third region, wherein each region has a corresponding angle between a side of the radiating element in the region and a center axis of the radiating element, and wherein θ1 is the angle in said first region, θ2 is the angle in said second region, θ3 is the angle in said third region, and θ1>θ2 and θ2<θ3.

15. An antenna comprising:

an isosceles triangle-like first conducting plate; and an isosceles triangle-like second conducting plate, wherein the first conducting plate and the second conducting plate form a bowtie antenna, wherein at least one of the first conducting plate and the second conducting plate includes first, second and third regions, with the first region positioned closest and opposed to another conducting plate, the third region positioned furthest from said another conducting plate, and the second region positioned between said first and third regions, wherein each region has a corresponding angle between a side of the radiating element in the region and a center axis of the radiating element, and wherein θ1 is the angle in said first region, θ2 is the angle in said second region, θ3 is the angle in said third region, and θ1>θ2 and θ2<θ3.

16. An information communication apparatus comprising an antenna, the antenna comprising:

a grounded conductor;

a radiating element including first, second and third regions, with the first region positioned closest and opposed to the grounded conductor, the third region positioned furthest from the grounded conductor, and the second region positioned between said first and third regions, wherein a first diameter in said first region is smaller than a second diameter in said second region and a third diameter in said third region, and said second diameter in said second region is smaller than said third diameter in said third region, wherein each region has a corresponding angle between a side of the radiating element in the region and a center axis of the radiating element, and wherein θ1 is the angle in said first region, θ2 is the angle in said second region, θ3 is the angle in said third region, and θ1>θ2 and θ2<θ3.

17. An information communication apparatus comprising an antenna, the antenna comprising:

a grounded conductor; and a radiating element having a diameter that increases from the top of the radiating element to the bottom of the radiating element, the top of the radiating element being opposed to the grounded conductor, wherein the radiating element is shaped such that a first angle between a side of the radiating element and a center axis of the radiating element changes multiple times from the top to the bottom, and the radiating element includes three regions positioned from the top to the bottom, each region having a second angle between an envelope of the side of the radiating element in the region and a center axis of the radiating element, wherein the second angles of the three regions satisfy the relationship θ1>θ2 and θ2<θ3 when the second angles are indicated by θ1, θ2 and θ3 respectively from the top to the bottom.

18. An information communication apparatus comprising an antenna, the antenna comprising:

a grounded conductor; and a radiating element including first, second and third regions, with the first region positioned closest and opposed to the grounded conductor, the third region positioned furthest from the grounded conductor, and the second region positioned between said first and third regions, wherein a first diameter in said first region is smaller than a second diameter in said second region and a third diameter in said third region, and said second diameter in said second region is smaller than said third diameter in said third region, wherein the radiating element is shaped such that a first angle between a side of the radiating element and a center axis of the radiating element changes multiple times from the first region to the third region, wherein each region has a corresponding second angle between an envelope of the side of the radiating element in the region and the center axis of the radiating element, and wherein θ1 is the second angle in said first region, θ2 is the second angle in said second region, θ3 is the second angle in said third region, and θ1>θ2 and θ2<θ3.

19. An information communication apparatus comprising antenna, the antenna comprising:

an isosceles triangle-like first conducting plate; and an isosceles triangle-like second conducting plate, wherein the first conducting plate and the second conducting plate form a bowtie antenna, wherein at least one of the first conducting plate and the second conducting plate includes first, second and third regions, with the first region positioned closest and opposed to another conducting plate, the third region positioned furthest from said another conducting plate, and the second region positioned between said first and third regions, wherein each region has a corresponding angle between a side of the radiating element in the region and a center axis of the radiating element, and wherein θ1 is the angle in said first region, θ2 is the angle in said second region, θ3 is the angle in said third region, and θ1>θ2 and θ2<θ3.

* * * * *